US007607310B2

(12) United States Patent
Morris et al.

(10) Patent No.: US 7,607,310 B2
(45) Date of Patent: Oct. 27, 2009

(54) STORAGE OF NATURAL GAS IN LIQUID SOLVENTS AND METHODS TO ABSORB AND SEGREGATE NATURAL GAS INTO AND OUT OF LIQUID SOLVENTS

(75) Inventors: Ian Morris, Camball River (CA); Patrick A. Agnew, Calgary (CA); Bruce Hall, Katy, TX (US)

(73) Assignee: SeaOne Maritime Corp., Houston, TX (US)

( * ) Notice: Subject to any disclaimer, the term of this patent is extended or adjusted under 35 U.S.C. 154(b) by 47 days.

(21) Appl. No.: 10/928,757

(22) Filed: Aug. 26, 2004

(65) Prior Publication Data

US 2006/0042273 A1 Mar. 2, 2006

(51) Int. Cl.
*F17C 11/00* (2006.01)

(52) U.S. Cl. ..... 62/46.1; 62/50.1

(58) Field of Classification Search ..... 62/45.1, 62/48.1, 50.1, 46.1, 50.2, 625, 331, 259.1, 62/262, 263, 298, 407, 426, 419, 48.2, 49.1, 62/53.2, 4, 41; 95/228, 229, 237; 40/725, 40/720, 722, 723, 733; 210/175, 258, 511; 96/242

See application file for complete search history.

(56) References Cited

U.S. PATENT DOCUMENTS

| | | | | |
|---|---|---|---|---|
| 2,497,793 | A | 2/1950 | Ransome | |
| 2,550,844 | A | 5/1951 | Meiller et al. | |
| 3,232,725 | A | 2/1966 | Secord et al. | |
| 3,256,709 | A | 6/1966 | Stepleton | |
| 3,298,805 | A | 1/1967 | Secord et al. | |
| 3,407,613 | A | 10/1968 | Muller et al. | |
| 4,010,622 | A | 3/1977 | Etter | |
| 4,024,720 | A | 5/1977 | Dimentsberg et al. | |
| 4,139,019 | A | 2/1979 | Bresie et al. | |
| 4,203,742 | A | 5/1980 | Agnihotri | |
| 4,479,350 | A | 10/1984 | Newton et al. | |
| 4,622,053 | A * | 11/1986 | Tomlinson et al. | 62/621 |
| 5,315,054 | A | 5/1994 | Teel | |
| 6,174,440 | B1 * | 1/2001 | Charron et al. | 210/634 |
| 6,201,163 | B1 | 3/2001 | Morris et al. | |
| 6,217,626 | B1 | 4/2001 | Morris et al. | |

(Continued)

FOREIGN PATENT DOCUMENTS

| | | |
|---|---|---|
| GB | 1415729 | 11/1975 |

*Primary Examiner*—Mohammad M Ali
(74) *Attorney, Agent, or Firm*—Orrick, Herrington & Sutcliffe LLP

(57) ABSTRACT

Systems and processes that facilitate the absorption of natural gas or methane through the interaction of moderate pressure and low temperature into a liquid or liquid vapor medium for storage and transport, and back into a gas for delivery to market. In a preferred embodiment, the absorptive properties of ethane, propane and butane under moderate conditions of temperature and pressure (associated with a novel mixing process) are utilized to store natural gas or methane at more efficient levels of compressed volume ratio than are attainable with natural gas alone under similar holding conditions. The preferred mixing process efficiently combines natural gas or methane with a solvent medium such as liquid ethane, propane, butane, or other suitable fluid, to form a concentrated liquid or liquid vapor mixture suited for storage and transport. The solvent medium is preferably recycled in the conveyance vessel on unloading of the natural gas.

22 Claims, 11 Drawing Sheets

U.S. PATENT DOCUMENTS 6,260,501 B1 7/2001 Agnew
6,339,996 B1 1/2002 Campbell
6,449,961 B1 9/2002 Korsgaard
6,584,780 B2 * 7/2003 Hibino et al. ..... 62/46.1
6,584,781 B2 7/2003 Bishop et al.
6,613,126 B2 9/2003 Tange et al.
6,655,155 B2 12/2003 Bishop
7,121,115 B2 * 10/2006 Lemaire et al. ..... 62/625
2003/0061820 A1 * 4/2003 Bishop ..... 62/45.1

* cited by examiner

DISCHARGE CYCLE

STORAGE OF NATURAL GAS IN LIQUID SOLVENTS AND METHODS TO ABSORB AND SEGREGATE NATURAL GAS INTO AND OUT OF LIQUID SOLVENTS

FIELD OF THE INVENTION

The invention relates generally to the storage and transport of natural gas and, more particularly, to the bulk storage of natural gas in a liquid medium or solvent and systems and methods for absorbing natural gas into a liquid or liquid vapor medium for storage and transport, and segregating back into a gas for delivery. The method of transport is by conventional road, rail, and ship modes utilizing the contained natural gas in concentrated form.

BACKGROUND INFORMATION

Natural gas is predominantly transported in gaseous form by pipeline. For natural gas deposits not located in close proximity to a pipeline and, thus, not feasibly transported over a pipeline, i.e., stranded or remote natural gas, the gas must be transported by other means and is often transported in liquid form as liquid natural gas ("LNG") in ships. Natural gas storage and transport in liquid form involves a state at either cryogenic or near cryogenic temperatures (−270 degrees F. at atmospheric pressure to −180 degrees F. at pressure), which requires a heavy investment in liquefaction and re-gasification facilities at each end of the non-pipeline transport leg, as well as heavy investment in large storage tankers. These capital costs along with high energy expenditures necessary to store and transport LNG at these states tend to make the storage and transportation of natural gas in liquid form quite costly.

In recent years, transportation of stranded or remote natural gas assets as compressed natural gas ("CNG") has been proposed, but has been slow to commercialize. CNG, which includes compressing the gas at pressures of 100 to several hundred atmospheres, offers volumetric ratios of containment between one third and one half of the 600 to 1 (600:1) volumetric ratios obtained with LNG without the heavy investment in liquefaction and re-gasification facilities.

The shipment of CNG at atmospheric temperatures or chilled conditions to −80 degrees F. is presently the subject of industry proposals. Compressing natural gas to 2150 psig (146 atm) places the gas compressibility (Z) factor at its lowest value, (approx 0.74 at 60 degrees F.) before it climbs to higher values at elevated pressures. At 2150 psig a compressed volume ratio on the order of 225:1 is attainable. Commercial tankage at 3600 psig is commonly used to pack natural gas to a compressed volume ratio of 320:1.

To effectively deliver stranded or remote natural gas into the shipping cycle it must be held in storage in quantities suited to the frequency of transport vessels and the production rate at the gas source. Loading, preferably achieved in a minimum amount of time, is also factored into this storage computation. Similarly, unloading must be into a storage system sized based on frequency of deliveries, unloading time and take away capacity of the pipeline feeding the natural gas to market. Holding a natural gas vessel at these staging points is part of the delivery costs associated with all transport modes.

CNG handling is energy intensive requiring significant compression and cooling to these volumetric ratios, and then displacing the gas upon unloading. Given the relatively high cost of storing high pressure CNG, lengthy loading and unloading times and associated cooling or reheating capacity, no commercial system is yet operational to prove the possibility of conveying bulk volumes over 0.5 bcf/day.

Accordingly, it would be desirable to provide superior natural gas concentrations than those obtainable with CNG and at moderate pressures and moderately reduced temperatures to facilitate better performance parameters than CNG, and reduce the proportionate intensity of equipment required for LNG.

SUMMARY

The present invention is directed to natural gas or methane stored in a liquefied medium through the interaction of moderate pressure, low temperature and a solvent medium, and to systems and methods that facilitate the absorption of natural gas or methane into a liquid or liquid vapor medium for storage and transport, and back into a gas for delivery to market. The method of transport is preferably by conventional road, rail, and ship modes utilizing contained natural gas or methane in concentrated form. This method of gas storage and transportation is also adaptable for pipeline use.

In a preferred embodiment, the absorptive properties of ethane, propane and butane are utilized under moderate temperature and pressure conditions (associated with a novel mixing process) to store natural gas or methane at more efficient levels of compressed volume ratio than are attainable with natural gas alone under similar holding conditions. The mixture is preferably stored using pressures that are preferably no higher than about 2250 psig, and preferably in a range of about 1200 psig to about 2150 psig, and temperatures preferably in a range of about −20° to about −100° F., more preferably no lower than about −80° F. and more preferably in a range of about −40° to −80° F. Natural gas or methane is combined at these moderate temperatures and pressures condition with a liquefied solvent such as ethane, propane or butane, or combinations thereof, at concentrations of ethane preferably at about 25% mol and preferably in the range of about 15% mol to about 30% mol; propane preferably at about 20% mol and preferably in a range of about 15% mol to about 25% mol; or butane preferably at about 15% and preferably in a range of about 10% mol to about 30% mol; or a combination of ethane, propane and/or butane, or propane and butane in a range of about 10% mol to about 30% mol.

The mixing process of the present invention efficiently combines natural gas or methane with a solvent medium such as liquid ethane, propane, butane, or other suitable fluid, to form a concentrated liquid or liquid vapor mixture suited for storage and transport. The solvent medium is preferably recycled in the conveyance vessel on unloading of the natural gas. Process conditions are preferably determined according to the limits of efficiency of the solvent used.

In a preferred embodiment, the solvent is preferably pressure sprayed under controlled rates into a stream of natural gas or methane entering a mixing chamber. On meeting the absorption stream (solvent), the gas falls into the liquid phase gathering in the lower part of the mixing chamber as a saturated fluid mixture of gas and solvent, where it is then pumped to storage with minimal after cooling. Handling the gas in liquid form speeds up loading and unloading times and does not require after-cooling at levels associated with CNG.

The gas is then segregated from the solvent for delivery to market. The gas is segregated from the solvent in a separator at an ideal temperature and pressure matching the required delivery condition. Temperature will vary based on solvent being used. The liquid solvent is recovered for future use.

Other systems, methods, features and advantages of the invention will be or will become apparent to one with skill in the art upon examination of the following figures and detailed description.

BRIEF DESCRIPTION OF THE FIGURES

The details of the invention, including fabrication, structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

DETAILED DESCRIPTION

In accordance with the present invention, natural gas or methane is preferably absorbed and stored in a liquefied medium through the interaction of moderate pressure, low temperature and a solvent medium. In a preferred embodiment, the absorptive properties of ethane, propane and butane are utilized under moderate temperature and pressure conditions to store natural gas or methane at more efficient levels of compressed volume ratio than are attainable with natural gas or methane alone under similar holding conditions. A novel mixing process preferably combines natural gas or methane with a solvent medium such as liquid ethane, propane, butane, or other suitable fluid, to form a concentrated liquid or liquid vapor mixture suited for storage and transport. The solvent medium is preferably recycled in the conveyance vessel on unloading of the natural gas or methane.

In a preferred embodiment, an absorption fluid is preferably pressure sprayed under controlled rates into a stream of natural gas or methane entering a mixing chamber. The gas stream is preferably chilled to a mixing temperature by reduction of its pressure while flowing through a Joule Thompson valve assembly or other pressure reducing device, and/or flowing through a cooling device. On meeting the absorption fluid stream, the gas falls into the liquid solvent gathering in the lower part of the mixing chamber in the form of a saturate fluid. From the lower part of the mixing chamber the saturated fluid, a mixture of gas and liquid solvent, is pumped to storage with minimal after cooling. Handling the gas while absorbed in a liquid medium speeds up loading and unloading times and does not require after-cooling at levels associated with CNG.

Figure 1:
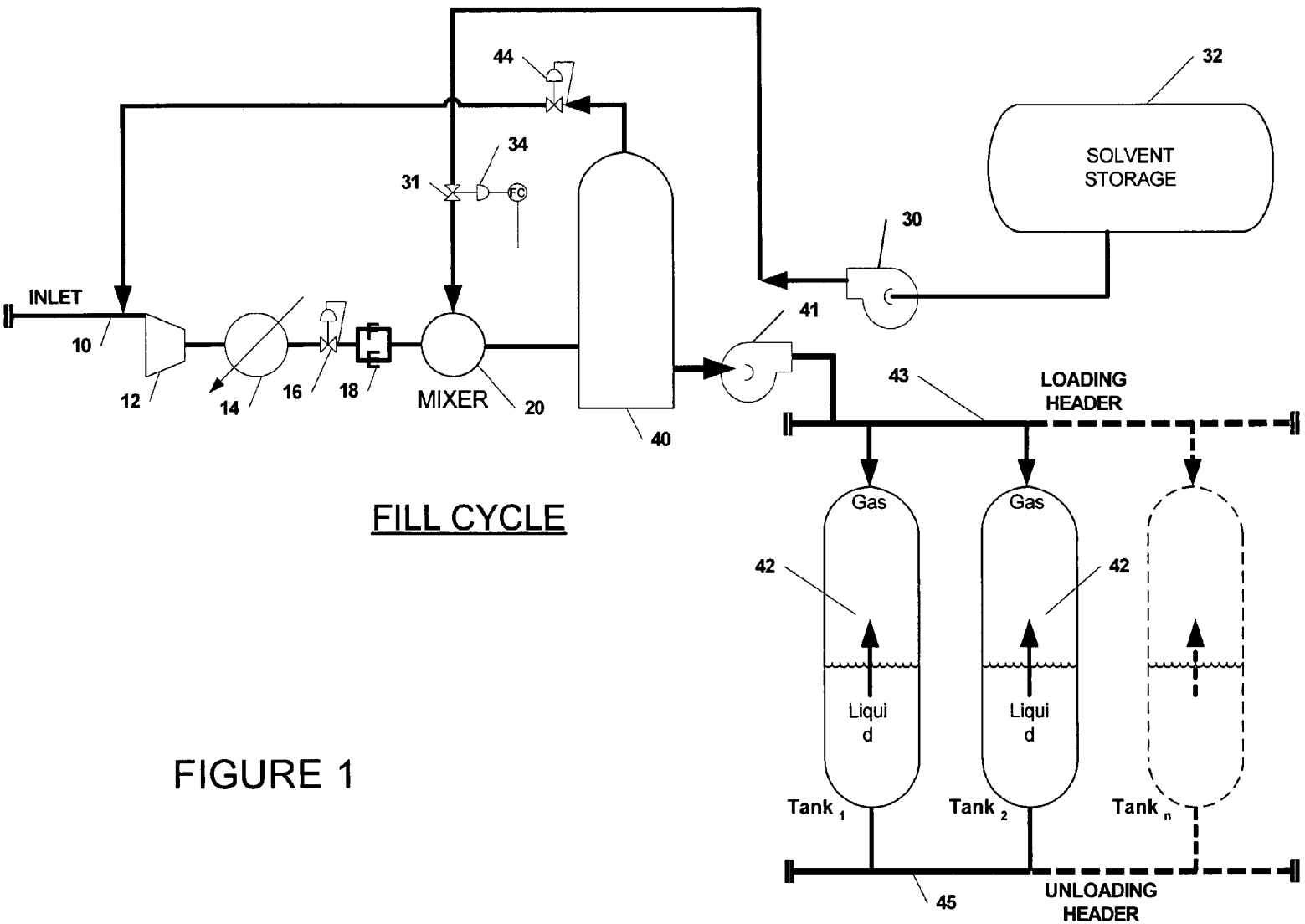
FIG. 1 is a process diagram that depicts a fill cycle of the process of the present invention.

Turning in detail to the figures, a process flow diagram of the fill cycle is provided in FIG. 1. As depicted, a stream of natural gas or methane is absorbed into a solvent to create a storage/transport mixture in saturated fluid form. Depending upon the solvent used, different optimal temperature and pressure parameters will be required to attain the desired volumetric ratios of the gas within the solvent.

In operation, the solvent is stored in a storage vessel 32 at a chilled temperature matching that of preferred gas storage conditions and solvent liquid phase maintenance conditions. Gas entering an inlet manifold 10 has its pressure raised via a gas compressor 12. The gas exiting the compressor 12 is then cooled to the same temperature as the stored solvent while passing through an air cooler/chiller train 14. The gas exiting the chiller train 14 is then fed at a controlled pressure governed by a pressure regulator 16 through a flow element 18 to a mixer or mixing chamber 20. The controlled pressure of the gas varies according to the gas mix being processed for storage and transport. The optimal storage conditions depend on the particular solvent used.

The mixer 20 is also supplied with a solvent injected from a pump 30. The solvent flow rate is governed by a flow controller 34 and flow control valve 31. Information from the flow element 18 is fed to the flow controller 34 to match on a molar volume basis the desired solvent flow rate with that of the gas.

Not shown in FIG. 1 is the use of a Joule Thompson valve before the inlet manifold 10. A Joule Thompson valve is preferably incorporated for very high well-head pressures requiring a drop in pressure to that of the process train. The pressure drop across the valve also creates a useable temperature drop in the gas stream.

On meeting the solvent, the gas is absorbed and carried within a liquid phase medium. This liquid phase medium gathers in the lower part of the mixing chamber 20 with the solvent as a saturated fluid. The saturated fluid plus a small amount of excess gas is carried into a stabilizer vessel 40. Excess gas is cycled back through a pressure control valve 44 to the inlet manifold 10 for recycling through the mixer 20.

The saturated fluid is then boosted in pressure to preferred storage levels by a packing pump 41 from which it is fed into a loading header 43 and then packed into holding tanks or storage vessels 42 fed by the loading header 43. Chilled blanket gas such as methane, ethane, propane, butane or mixtures thereof is preferably found in the tanks 42 prior to the tanks 42 being filled with the saturated fluid. The blanket gas liquefies as the tanks 42 are filled with the saturated fluid. Tanks mounted on board a ship are preferably contained within a sealed enclosure filled with a blanket of chilled inert atmosphere. The stored saturated fluid is maintained at the appropriate temperature during storage and transit.

Figure 2:
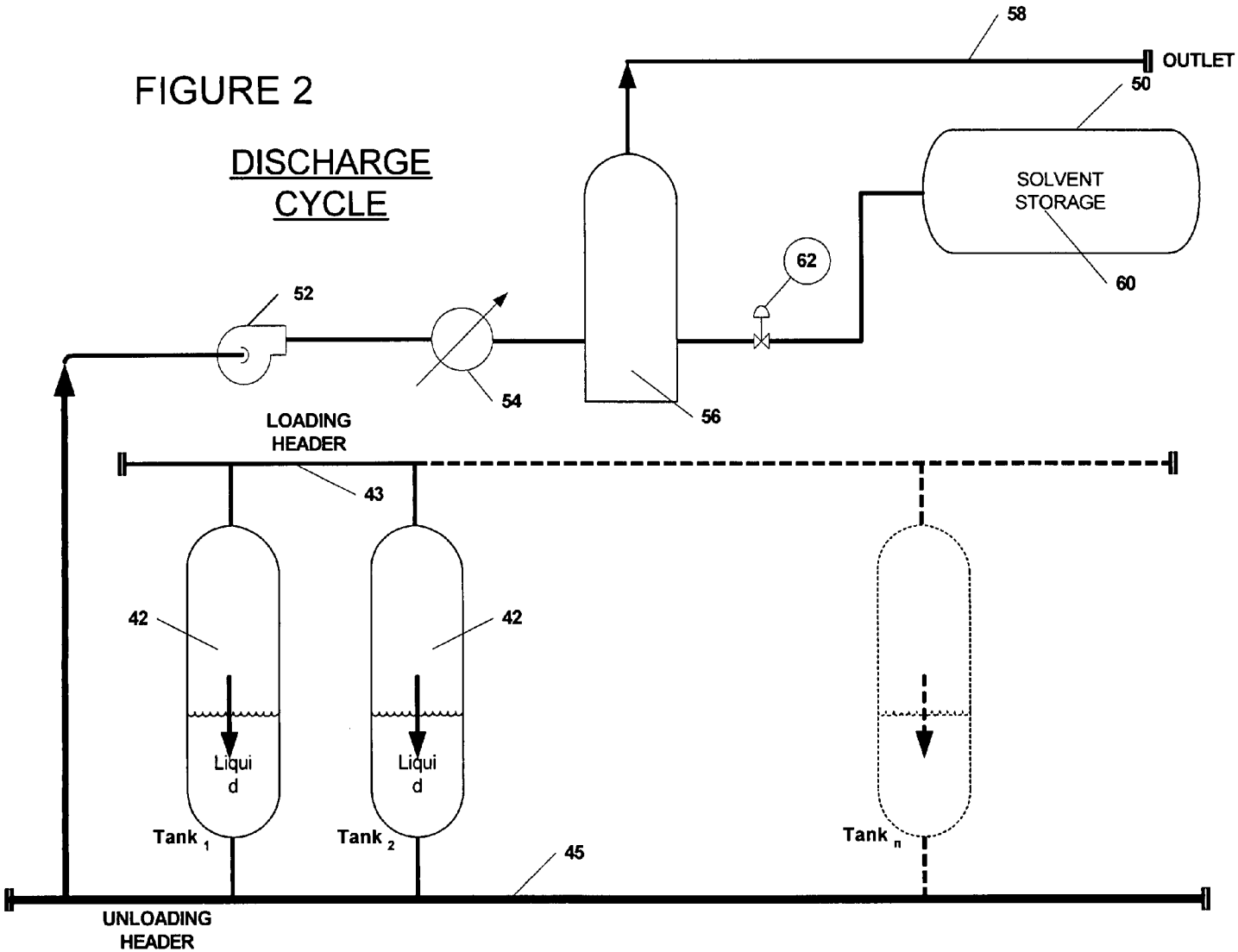
FIG. 2 is a process diagram that depicts a discharge/unloading cycle of the process of the present invention.

Turning to FIG. 2, a process flow diagram of a discharge/unloading cycle is provided where the saturated fluid stored in the holding tanks 42 is separated into a gas stream and stream of recovered solvent. The saturated fluid is fed from the tanks 42 through an unloading header 45 to a discharge pump 52 where it has its pressure raised sufficiently to pass through a heat exchanger 54. In the heat exchanger 54, the temperature of the saturated fluid is raised to obtain an optimal energy level for re-gasification. The re-gasified processed stream is then passed into a separator tower 56 where a drop in pressure causes the solvent to return to its liquid phase and separate from the gas. The gas stream exits the separator tower 56 and is delivered to storage or pipeline facilities through an outlet header 58, while the solvent from the lower part of the vessel is returned via a pressure control valve 62 to a storage vessel 60 for re-use.

The systems and methods described in regard to FIGS. 1 and 2 facilitate the absorption of natural gas into a liquid or liquid vapor medium for storage and transport, and the segregation of the gas for delivery to market and the retention of the solvent for reuse as a carrier medium. The process advantageously provides natural gas and methane volumetric ratios superior to those obtainable with CNG, enhanced performance parameters over those of a CNG operation and a reduction in the proportionate intensity of equipment required for LNG. The creation of the stored saturated fluid and subsequent reconstituted products for delivery is advantageously brought about with less energy expenditure than is involved in processing and reconstituting either CNG or LNG back to a pressurized gas at ambient temperature. Moreover, natural gas or methane retained in a liquid medium can advantageously be transferred by simply pumping, as compared to the compression, decompression and drawdown-compression stages involved in the transfer of CNG. As one skilled in the art would understand, this greatly improves on the economics associated with the storage and transportation of chilled CNG in current industry proposals.

The reduction in costs relative to CNG handling is further related to the reduction in capital requirements for containment through the use of lighter, higher strength materials, often composite or fiber reinforced in nature. It will be understood by those skilled in the art that the impact on a lower quantity of material for the lower operating pressures quoted above will further add to the economic viability of the invention.

Unlike conventional processes (see, e.g., Teal U.S. Pat. No. 5,513,054), the process of the present invention is not intended for the creation of a fuel mix, but rather for the storage and transport of natural gas (methane) with the solvent being recovered for reuse. The mixture advantageously allows for transport of the medium both in the liquid phase or within the liquid phase envelope of the gas mix.

Figure 3A:
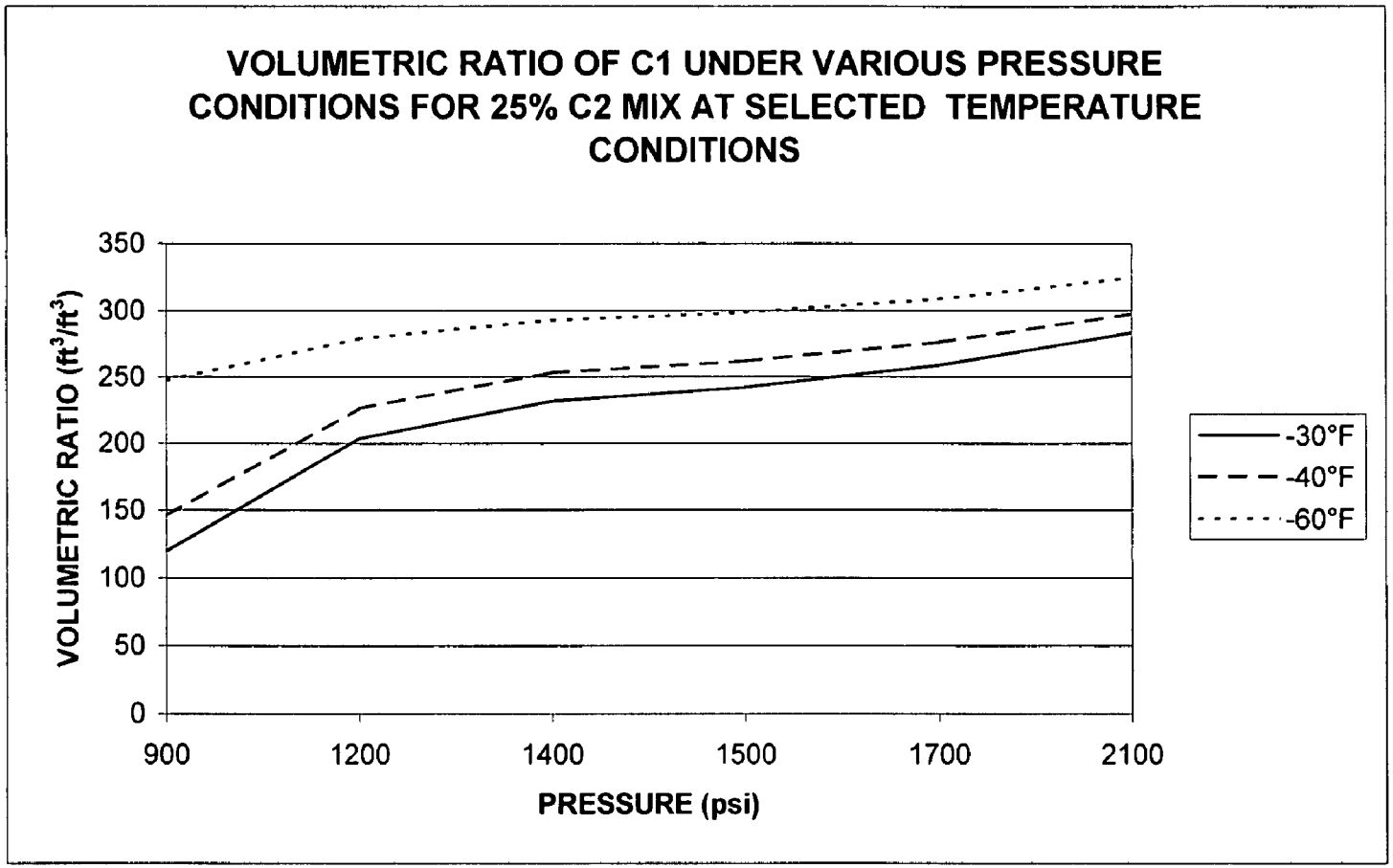
FIG. 3*a* is a graph depicting volumetric ratio of methane (C1) under various pressure conditions for a 25% ethane (C2) mix at selected temperatures.
Figure 3B:
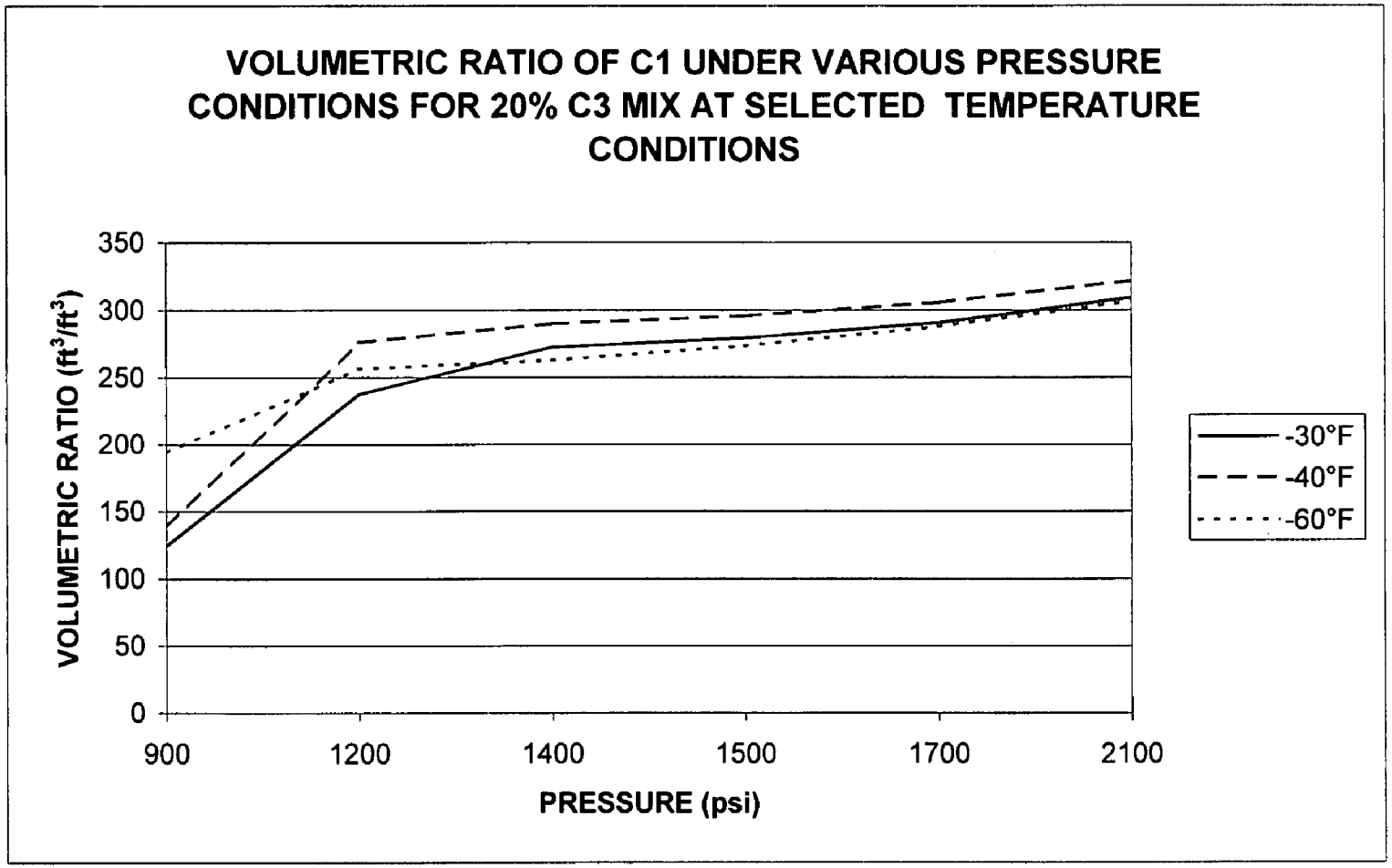
FIG. 3*b* is a graph depicting volumetric ratio of methane (C1) under various pressure conditions for a 20% propane (C3) mix at selected temperatures.
Figure 3C:
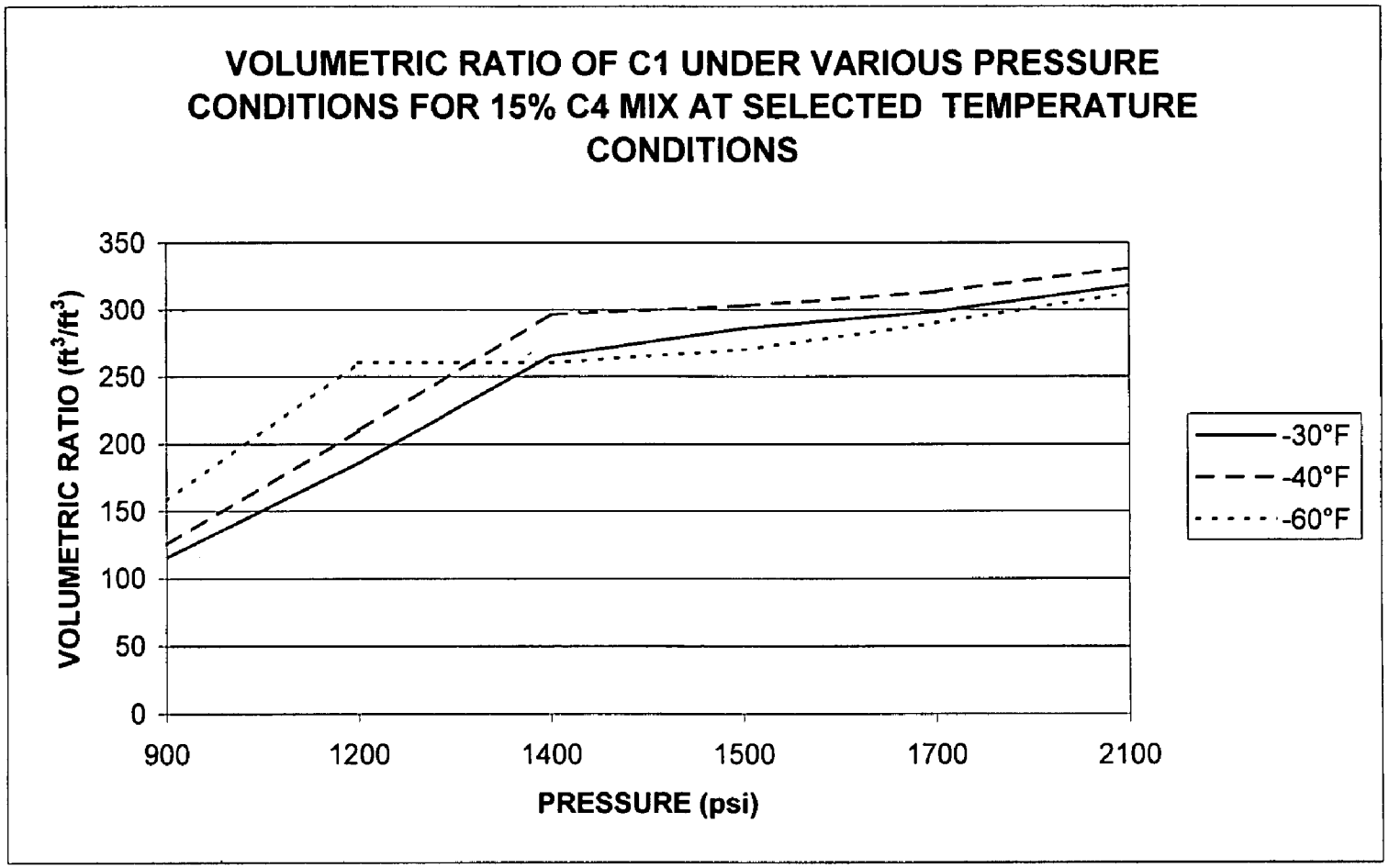
FIG. 3*c* is a graph depicting volumetric ratio of methane (C1) under various pressure conditions for a 15% butane (C4) mix at selected temperatures.
Figure 4A:
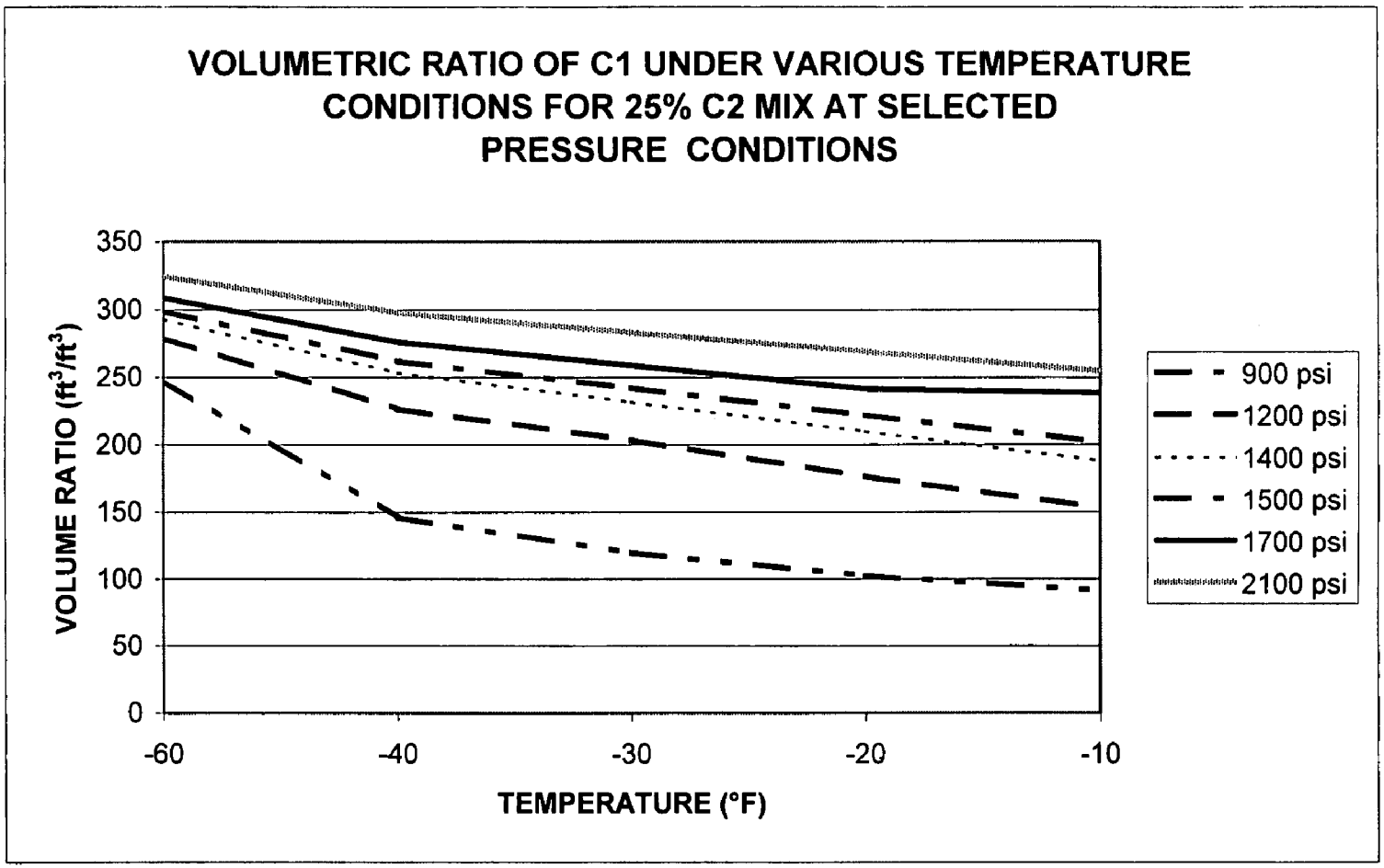
FIG. 4*a* is a graph depicting volumetric ratio of methane (C1) under various temperature conditions for a 25% ethane (C2) mix at selected pressures.
Figure 4B:
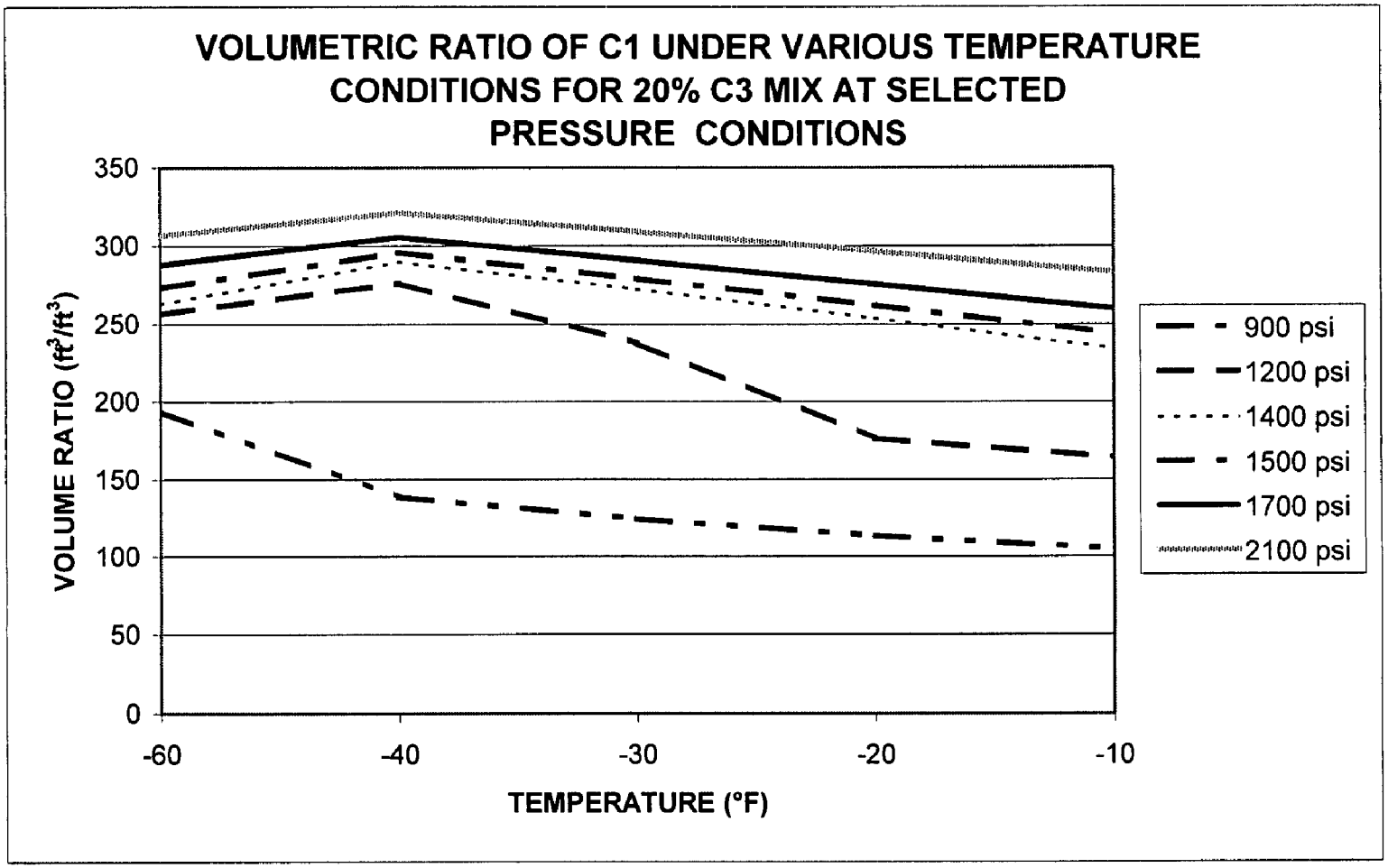
FIG. 4*b* is a graph depicting volumetric ratio of methane (C1) under various temperature conditions for a 20% propane (C3) mix at selected pressures.
Figure 4C:
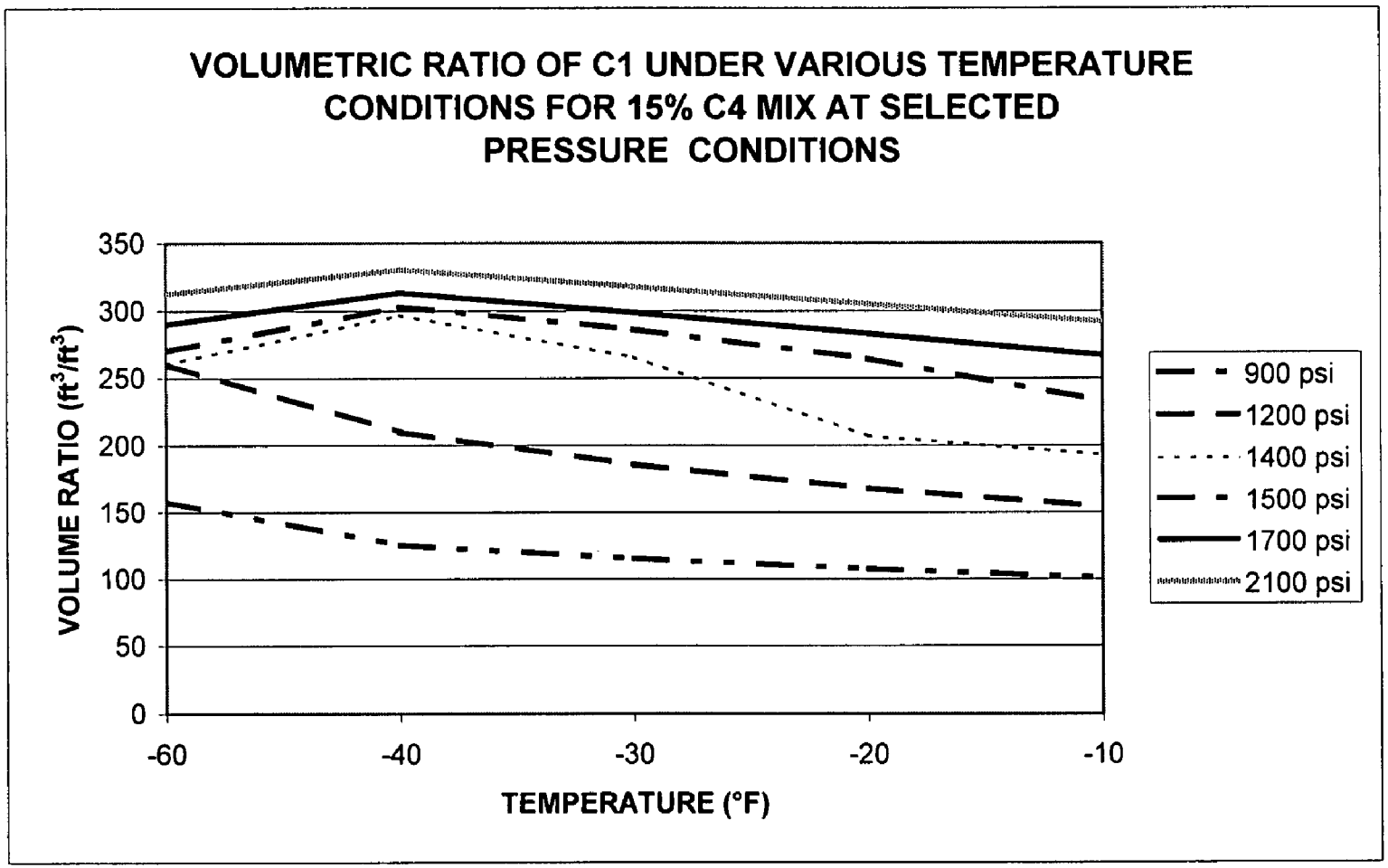
FIG. 4*c* is a graph depicting volumetric ratio of methane (C1) under various temperature conditions for a 15% butane (C4) mix at selected pressures.
Figure 5A:
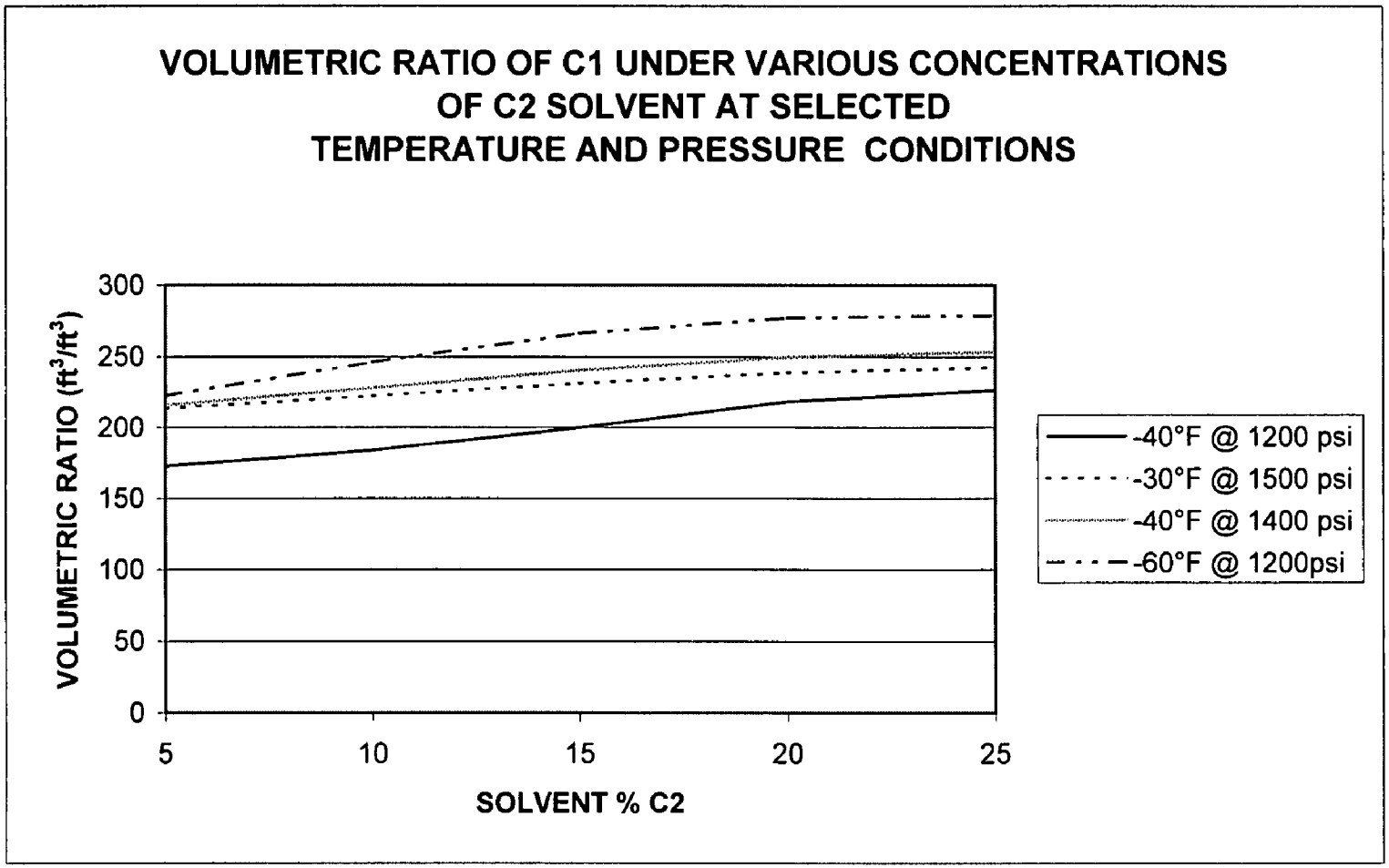
FIG. 5*a* is a graph depicting volumetric ratio of methane (C1) under various concentrations of ethane (C2) solvent at selected temperature and pressure conditions.
Figure 5B:
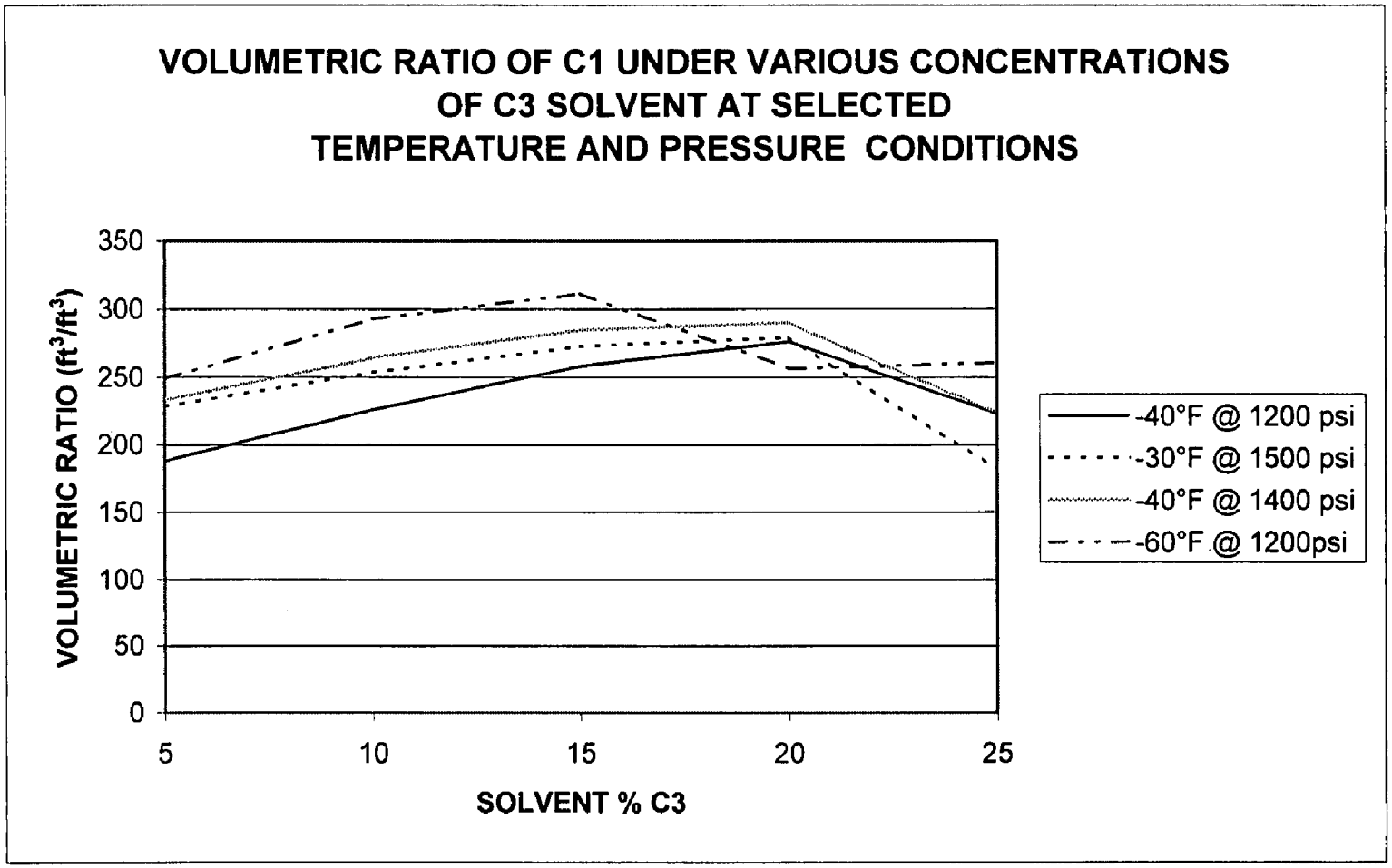
FIG. 5*b* is a graph depicting volumetric ratio of methane (C1) under various concentrations of propane (C3) solvent at selected temperature and pressure conditions.
Figure 5C:
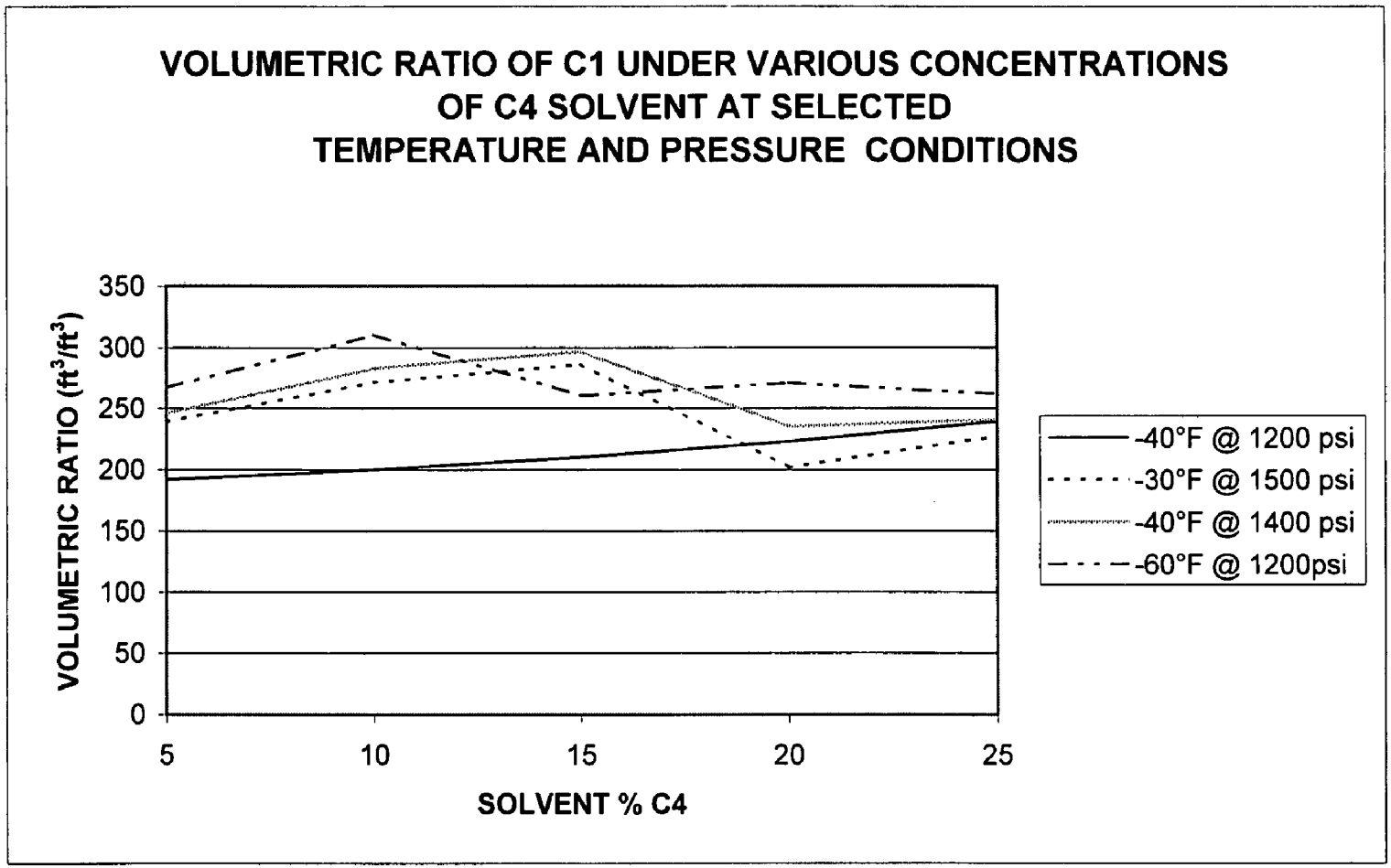
FIG. 5*c* is a graph depicting volumetric ratio of methane (C1) under various concentrations of butane (C4) solvent at selected temperature and pressure conditions.

Process conditions are preferably determined according to limits of efficiency of each of the absorption fluids or solvents used. Turning to FIGS. 3*a-c*, 4*a-c*, and 5*a-c*, the volumetric ratios of methane (C1) under a variety of pressure and temperature conditions and a variety of saturated fluid mixture concentrations of ethane (C2), propane (C3) and butane (C4) solvents is depicted. FIGS. 3*a*, 3*b* and 3*c* illustrate that the volumetric ratio of methane (C1) is in a range of about one-third to one-half of LNG at pressures in a range of about 1200 psi to about 2100 psi for selected solvent concentrations and temperature conditions. The volumetric ratio of methane (C1), as depicted in FIGS. 4*a*, 4*b* and 4*c*, is in a range of about one-third to one-half of LNG at temperatures in a range of about −30 to below −60F. for selected solvent concentrations and pressure conditions. The volumetric ratio of methane (C1), as depicted in FIGS. 5*a*, 5*b* and 5*c*, is in a range of about one-third to one-half of LNG at concentrations of ethane (C2) in a range of about 15% mol to about 25% mol, of propane (C3) in a range of about 10% mol to about 30% mol, and of butane (C4) in a range of about boo mol to about 30% mol for selected temperature and pressure conditions.

Accordingly, the present invention obtains natural gas volumetric ratios in liquid form superior to those obtainable in CNG operations and, as a result, economics of scale, by using pressures that are preferably no higher than about 2250 psig, and preferably in a range of about 1200 psig to about 2150 psig, and temperatures preferably in a range of about −20° F. to about −100° F., more preferably no lower than about −80° F. and more preferably in a range of about −40° F. to −80° F. Natural gas or methane is combined with a solvent, preferably liquid ethane, propane or butane, or combinations thereof, at the following concentrations: ethane preferably at about 25% mol and preferably in the range of about 15% mol to about 30% mol; propane preferably at about 20% mol and preferably in a range of about 15% mol to about 25% mol; or butane preferably at about 15% and preferably in a range of about 10% mol to about 30% mol; or a combination of ethane, propane and/or butane, or propane and butane in a range of about 10% mol to about 30% mol.

Preferred packing and storage parameters and associated compression performance levels are provided below for stored liquid mediums utilizing ethane, propane or butane as the solvent (pure methane compression follows in parenthesis):

Volumetric Ratio for Absorbed Natural Gas (vs. Compressed Natural Gas)

| | | | |
|---|---|---|---|
| A. Ethane - 25% mol | | | |
| 1200 psig | −60 degree F. | 276 ft3/ft3 | (203 ft3/ft3) |
| 1200 psig | −40 degree F. | 226 ft3/ft3 | (166 ft3/ft3) |
| 1400 psig | −40 degree F. | 253 ft3/ft3 | (206 ft3/ft3) |
| 1500 psig | −30 degree F. | 242 ft3/ft3 | (207 ft3/ft3) |
| B. Propane - 20% mol | | | |
| 1200 psig | −40 degree F. | 275 ft3/ft3 | (166 ft3/ft3) |
| 1200 psig | −30 degree F. | 236 ft3/ft3 | (153 ft3/ft3) |
| 1400 psig | −40 degree F. | 289 ft3/ft3 | (206 ft3/ft3) |
| 1500 psig | −30 degree F. | 279 ft3/ft3 | (207 ft3/ft3) |
| C. Butane - 15% mol | | | |
| 1200 psig | −60 degree F. | 269 ft3/ft3 | (203 ft3/ft3) |
| 1400 psig | −40 degree F. | 294 ft3/ft3 | (206 ft3/ft3) |
| 1500 psig | −40 degree F. | 301 ft3/ft3 | (225 ft3/ft3) |

As the data in A, B and C above indicates, compression performance levels for the stored liquid medium at the noted moderate pressures and temperatures are competitive in all instances to CNG at 2100 psig and −60° F. Similar performance levels to A, B and C for compression ratios can be expected for pure methane: (1) at pressures in the 2100 psig range and temperatures of −30 to −20° F.; and (2) at pressures in the 2500 psig range and temperatures of −10 to 0° F.

The gas is preferably stored and transported within a liquid medium utilizing composite vessels and interconnecting hoses for low temperature application from ambient down to −100° F., and steel vessels for moderate temperature applications down to −40° F. The method of transport is by conventional road, rail, and ship modes utilizing the contained natural gas in concentrated form. The transportation vessel may be a custom design or adaptation of an existing form intended for land or marine use. Material specification of proven non exotic equipment is intended to be used in storage vessel design.

Chilling during storage and transit can be any of a number of proven commercial systems presently available such as cascade propane. One of skill in the art would recognize that improvements in such equipment resulting in more efficient cooling to lower temperatures will result in improved compression performance in the present invention. (see FIGS. 3*a*-5*c*). De-pressuring, as required to recover the absorbent liquid and heating to re-vaporize the natural gas tends to require minimal energy by commencing at a pressure of only 1500 psig compared to the 3000 psig or higher expected in CNG systems. This also has a favorable impact on loading and unloading times.

In the foregoing specification, the invention has been described with reference to specific embodiments thereof. It will, however, be evident that various modifications and changes may be made thereto without departing from the broader spirit and scope of the invention. For example, the reader is to understand that the specific ordering and combination of process actions shown in the process flow diagrams described herein is merely illustrative, unless otherwise stated, and the invention can be performed using different or additional process actions, or a different combination or ordering of process actions. As another example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

What is claimed is:

1. A process of mixing natural gas with a hydrocarbon solvent to yield a liquid medium suited for storage and transport at greater storage densities than compressed natural gas at the same storage conditions, comprising:

cooling natural gas and a solvent to temperatures in a range from below −40° F. to about −80° F., wherein the solvent is a liquid hydrocarbon, combining a flow stream of the natural gas having a molar flow rate with a flow stream of the liquid hydrocarbon solvent having a molar flow rate determined as a function of the molar flow rate of the flow stream of the natural gas causing a phase change of the combined flow streams of the natural gas and the liquid hydrocarbon solvent into a single phase liquid medium of natural gas absorbed in the hydrocarbon solvent, compressing the single phase liquid medium at pressures in a range of about 1200 psig to about 2150 psig, and storing the single phase liquid medium in a storage vessel, wherein the natural gas of the single phase liquid medium is stored at storage densities that exceed storage densities of compressed natural gas for the same pressure and temperatures.

2. The process of claim 1 wherein the compressing step includes compressing the liquid medium at pressures in a range of about 1200 psig to about 1440 psig.

3. The process of claim 2 wherein the cooling step includes cooling the gas and solvent to temperatures in a range from below −40° F. to about −60° F.

4. The process of claim 1 wherein the cooling step includes cooling the flow streams of natural gas and hydrocarbon solvent to temperatures in a range from below −40° F. to about −60° F.

5. The process of claim 1 wherein the hydrocarbon solvent is ethane.

6. The process of claim 1 wherein the hydrocarbon solvent is propane.

7. The process of claim 1 wherein the hydrocarbon solvent is butane.

8. The process of claim 1 wherein the natural gas is methane.

9. The process of claim 1 further comprising the steps of reducing the pressure of the single phase liquid medium of natural gas absorbed in the hydrocarbon solvent to separate the natural gas and hydrocarbon solvent, and heating the natural gas to gasify the natural gas.

10. The process of claim 9 further comprising the step of maintaining the liquid medium at a pressure of 1440 psig or less and at temperatures in a range from below −40° F. to −60° F. or above prior to reducing the pressure of the liquid medium.

11. The process of claim 9 further comprising the step of maintaining the liquid medium at a pressure of 1440 psig or less and at temperatures in a range from below −40° F. to −80° F. or above prior to reducing the pressure of the liquid medium.

12. The process of claim 9 further comprising the step of maintaining the liquid medium at a pressure of 2150 psig or less and at temperatures in a range from below −40° F. to −60° F. or above prior to reducing the pressure of the liquid medium.

13. The process of claim 9 further comprising the step of maintaining the liquid medium at a pressure of 2150 psig or less and at temperatures in a range from below −40° F. to −80° F. or above prior to reducing the pressure of the liquid medium.

14. The process of claim 9 further comprising the step of storing the hydrocarbon solvent in liquid phase for future use.

15. The process of claim 4 wherein the storage densities of the natural gas of the single phase liquid medium are in a volumetric ratio range of 215 $ft^3/ft^3$ to 335 $ft^3/ft^3$.

16. The process of claim 4 wherein the hydrocarbon solvent is ethane and wherein the storage densities of the natural gas of the single phase liquid medium are in a volumetric ratio range of 226 $ft^3/ft^3$ to 326 $ft^3/ft^3$.

17. The process of claim 4 wherein the hydrocarbon solvent is propane and wherein the storage densities of the natural gas of the single phase liquid medium are in a volumetric ratio range of 265 $ft^3/ft^3$ to 320 $ft^3/ft^3$.

18. The process of claim 4 wherein the hydrocarbon solvent is butane and wherein the storage densities of the natural gas of the single phase liquid medium are in a volumetric ratio range of 215 $ft^3/ft^3$ to 335 $ft^3/ft^3$.

19. The process of claim 4 wherein the storage densities of the natural gas of the single phase liquid medium are at least 1.23 to 1.66 times greater than that of compressed natural gas under the same temperature and pressure.

20. The process of claim 4 wherein the hydrocarbon solvent is ethane and wherein the storage densities of the natural gas of the single phase liquid medium are at least 1.23 to 1.36 times greater than that of compressed natural gas under the same temperature and pressure.

21. The process of claim 4 wherein the hydrocarbon solvent is propane and wherein the storage densities of the natural gas of the single phase liquid medium are at least 1.40 to 1.66 times greater than that of compressed natural gas under the same temperature and pressure.

22. The process of claim 4 wherein the hydrocarbon solvent is butane and wherein the storage densities of the natural gas of the single phase liquid medium are at least 1.33 to 1.43 times greater than that of compressed natural gas under the same temperature and pressure.

* * * * *

UNITED STATES PATENT AND TRADEMARK OFFICE

CERTIFICATE OF CORRECTION

PATENT NO. : 7,607,310 B2
APPLICATION NO. : 10/928757
DATED : October 27, 2009
INVENTOR(S) : Morris et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 327 days.

Signed and Sealed this

Twelfth Day of October, 2010

David J. Kappos

David J. Kappos
*Director of the United States Patent and Trademark Office*